United States Patent [19]

Vatne

[11] Patent Number: 4,979,356

[45] Date of Patent: Dec. 25, 1990

[54] TORQUE WRENCH

[75] Inventor: Per A. Vatne, Kristiansand, Norway

[73] Assignee: Maritime Hydraulics A.S., Kristiansand, Norway

[21] Appl. No.: 340,072

[22] Filed: Apr. 18, 1989

[30] Foreign Application Priority Data

Apr. 19, 1988 [NO] Norway ..... 881685

[51] Int. Cl.[5] ..... B25B 13/50

[52] U.S. Cl. ..... 81/57.16; 81/57.19; 81/57.21; 81/57.14

[58] Field of Search ..... 81/57.14–57.16, 81/57.19, 57.21, 57.3, 57.22, 57.33–57.35

[56] References Cited

U.S. PATENT DOCUMENTS 4,348,920 9/1982 Boyadjieff ..... 81/57.16

4,603,464 8/1986 Smith, Jr. et al. ..... 81/57.16

*Primary Examiner*—D. S. Meislin

*Attorney, Agent, or Firm*—Cushman, Darby & Cushman

[57] ABSTRACT

A torque wrench comprises a split casing which can be divided to receive and grip pipes, each casing half comprising jaws which are synchronously movable to center and frictionally engage the pipe joints. The wrench has a split inner annulus which is mounted in and connected to a split intermediate annulus which is rotatably mounted in the split casing. The inner annulus is provided with at least two activable and displaceable clamping jaws in use, temporary and external transfer of a controlled torque is provided to the intermediate annulus. The torque is, in turn, transferred to the inner annulus by the aid of a connection, preferably in the form of pump cylinders, which at the same time activate and provide the displaceable clamping jaws with the necessary power. With a spinning motor, the wrench forms a combined spinning and torque wrench. With a back-up wrench, and mounted on a carriage the wrench assembly forms a complete roughneck.

10 Claims, 6 Drawing Sheets

TORQUE WRENCH

BACKGROUND OF THE INVENTION

The invention relates to a torque wrench for tightening and braking-out threaded joints between drill pipe and drill collar sections forming parts of a drill string.

The background of the present invention includes the problems and the amount of work needed related to inserting and unscrewing drill pipes on the drill floor during drilling operations, particularly with regard to inserting and removing a drill string into/from a drilling well in a tripping operation.

During the last 10 to 20 years, hydraulic/mechanical equipment was available to facilitate such operations. Equipment of this kind is called a roughneck, and one concept is shown in U.S. Pat. No. 4,348,920. In short, such a roughneck comprises a two-piece lower unit the lowermost member of which forms back-up wrenches, whereas the upper member acts as a torque tong or wrench. Such a wrench encircling grips a drill pipe joint, and, in a conventional drilling operation, the back-up wrenches will clasp the sleeve portion of the joint, and the torque wrench will clasp the tap portion of the joint. The wrench causes the final torque make-up, or breaking-out, respectively, between pipe sections, whereas the upper spinning means causes the pipe sections to be screwed in, or unscrewed, respectively. A similar concept is shown in U.S. Pat. No. 4,603,464.

Existing equipment is, obviously, limited as regards flexibility in case of changed diameters or dimensions. A drill string may comprise drill pipes having a diameter of 3,5" with a joint diameter of 4.5", and drill collars with diameters up to 9.5". With existing equipment, it is common practice to replace jaws in the gripping jaws of tongs at least once, perhaps twice, to accomodate diameter variations. Also, many tools lack capacity for the largest diameters.

SUMMARY OF THE INVENTION

According to the invention, a torque wrench is achieved which is flexible as regards various pipe dimensions or pipe diameters, and it is able to accomodate, e.g. the range from 3.5" drill pipes to 9.5" drill collars. Additionally, it contributes to autocentering the pipes in the wrench means. As distinct from previous concepts, the present torque wrench adapts the clamping moment to the pipe diameter. Thus, the pipe joints are spared, resulting in a longer life of the drill pipes. The structural design of the torque wrenches ensures a self-tightening effect of the jaws, resulting in a good and reliable frictional engagement between jaws and drill pipes over all of the range of pipe dimensions. The device according to the invention also permits a combination of the torque wrench with a spinning means into one unit. Combined with back-up wrenches, and mounted on a carriage, this will provide a less complicated build-up with fewer parts and a lower weight for the complete roughneck.

With conventional separate spinning and torque wrenches equipment, the components or units must be operated with the aid of separate control levers. Since each unit has several functions, e.g. clamping, spinning, opening spinning means, and closing, clamping, twisting, and opening torque wrenches, the operator will have to execute a large number of functions in each operation.

In a combined spinning and torque wrench, the number of functions to be carried out by the operator is minimized, torque tightening being a direct continuation of the spinning movement, and it will, consequently, be possible to operate with one lever.

According to the invention, the above advantages are achieved by a torque wrench of the kind mentioned above, comprising a split casing which may be separated to enclose pipes. Each casing half comprises jaws which are synchronously movable for centering and frictional engagement with the pipe sections. The device is characterized by the fact that the wrenches comprises a split internal annulus which is mounted in and connected with a split intermediate annulus, which is rotatably mounted in said split casing. The inner annulus is provided with at least two activable and displaceable clamping jaws and means are provided and temporary and external transmission of a controlled angular movement to the internediate annulus. The angular movement, in turn, is transmitted to the inner annulus by the aid of the aforementioned connection, the latter at the same time activating and tightening the displaceable clamping jaws with necessary force.

Advantageously, friction generating means are provided temporarily to restrain any relative movement between the inner annulus and the casing.

The connection between the inner annulus and the intermediate annulus may be achieved by the aid of at least one tangentially arranged and tangentially acting pump cylinder. Each pump cylinder is, preferably, hydraulic and in hydraulic communication with hydraulic radially acting clamping jaws. The clamping jaws may suitably be provided in elongated guiding cylinders to provide control and a firm grip of the jaws over the whole range of pipe diameters. Each pump cylinder may advantageously be double-acting and in connection with one hydraulic and two-directional clamping jaw via respective hydraulic circuits.

The intermediate annulus may advantageously comprise means for an operative connection with a spinner motor for controlled rotation of intermediate annulus and the connected inner annulus in order to form a combined spinning and torque wrench.

The wrench may suitably comprise a separate back-up wrench provided below and, correspondingly, being intended for gripping pipes of various dimensions, with one or both wrenches being substantially movable vertically along guides.

The spinning and torque wrench and the back-up wrench means are preferably provided on a carriage, with one or both tongs means being substantially movable in a vertical direction along common guides provided on the carriage to form a complete roughneck.

BRIEF DESCRIPTION OF THE DRAWINGS

Further objects, features, and advantages will appear from the following disclosure of an embodiment of the invention which is at present preferred and is described with reference to the attached drawings to illustrate the invention.

In the drawings.

DETAILED DESCRIPTION

Figure 5:
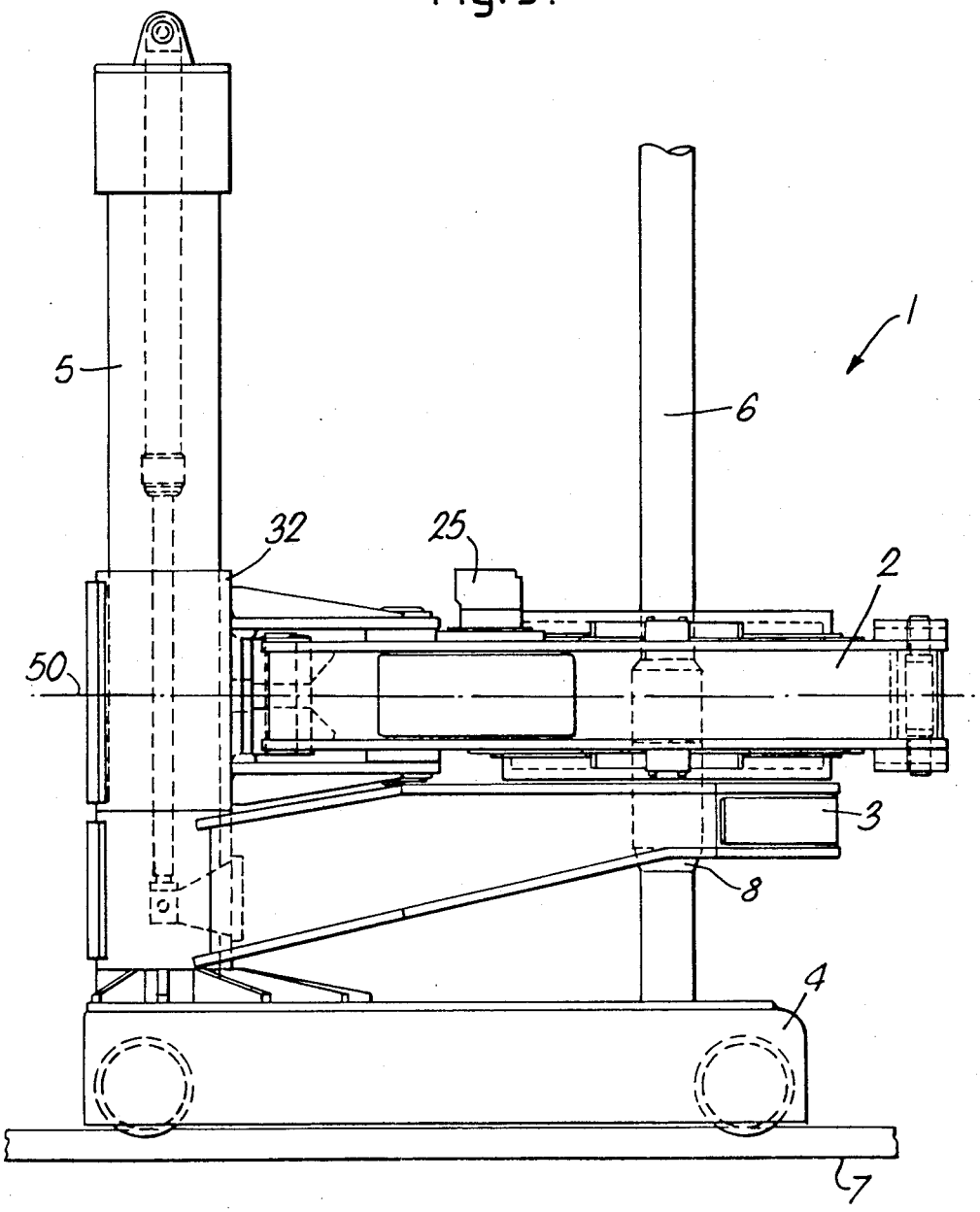
FIG. 5 is a diagrammatic side elevation of a complete roughneck comprising the torque tongs device, the spinning means, and the back-up tongs means.
Figure 6:
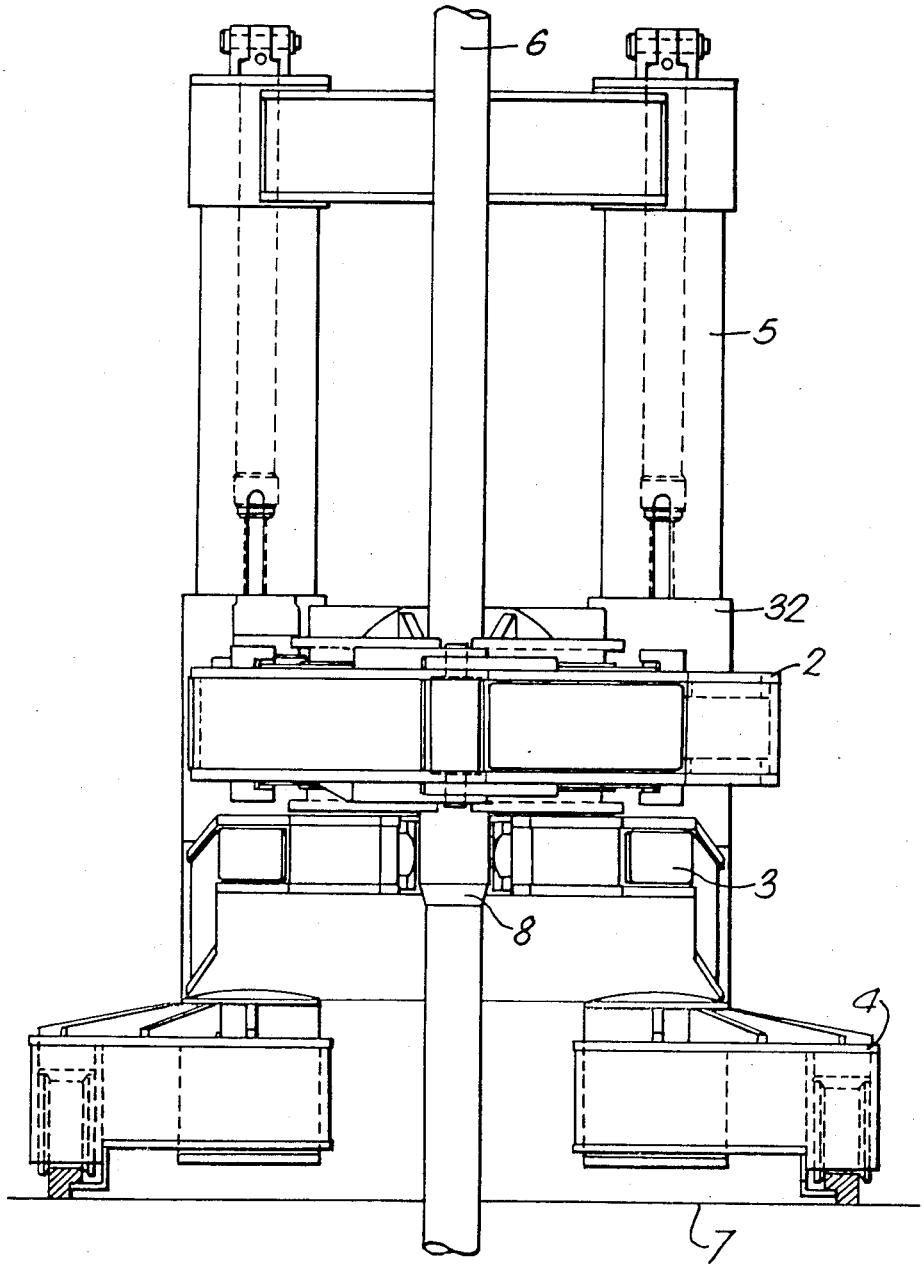
FIG. 6 is a diagrammatic front view of the roughneck according to FIG. 5.

FIGS. 5 and 6 show a complete roughneck 1, with torque tongs device 2 forming a first device control unit, and with a back-up tongs means 3 forming another device control unit. Both tongs are mounted on a carriage 4 provided with wheels for displacement, e.g. on a drill rig floor 7. Carriage 4 may be provided with wheels intended for moment on rails which are, in turn, mounted on drill rig floor 7. Vertically extending guides 5 are mounted on carriage 4 for controlled independent movement of torque tongs means 2, and back-up tongs means 3, respectively. As mentioned, complete roughneck 1 is intended for joining, tightening, breaking out, and unscrewing operations on pipe sections 6 by gripping sleeve and tap members 8, respectively.

Figure 1:
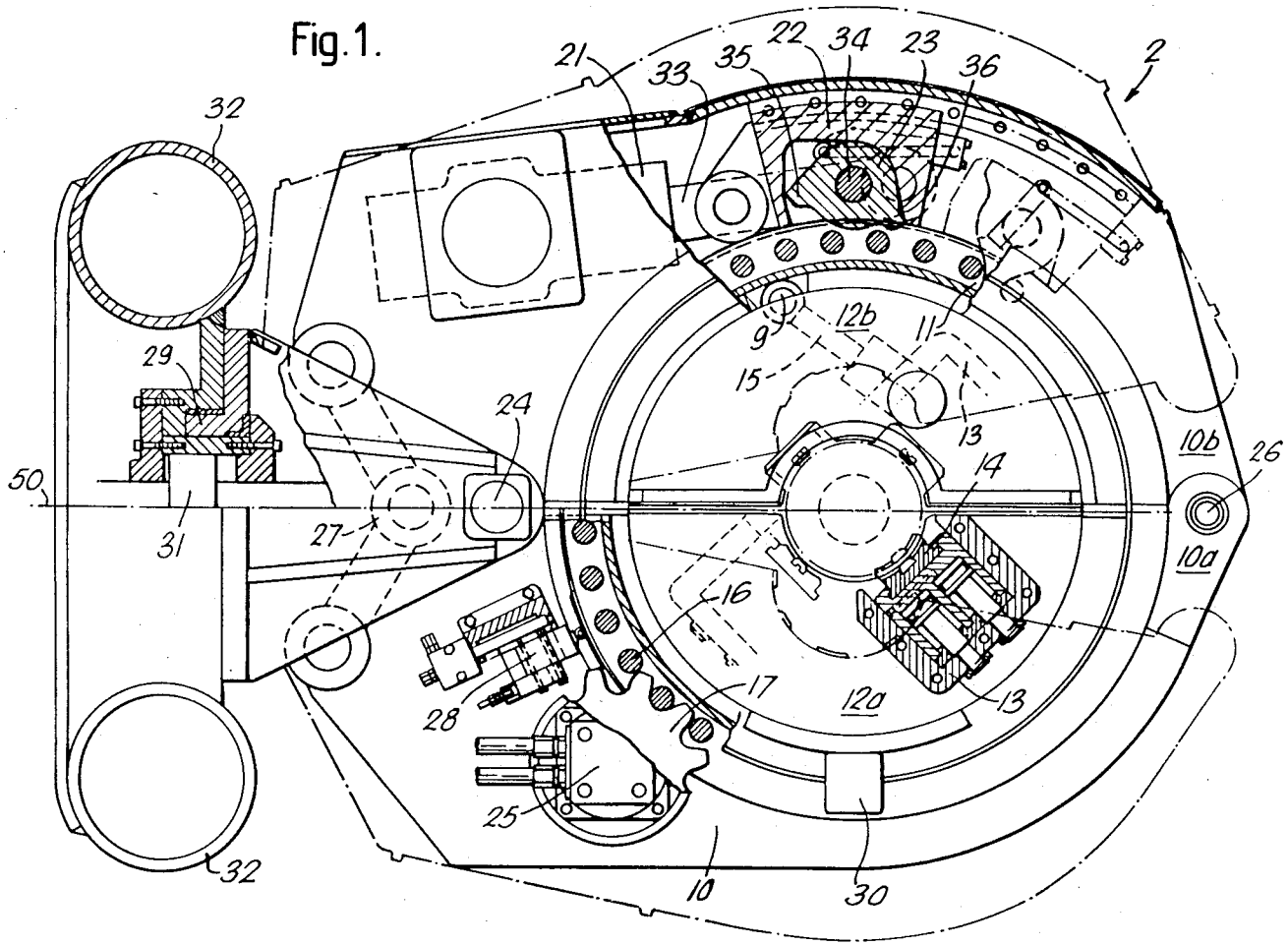
FIG. 1 is a diagrammatic top view of the torque tongs or wrench device according to the invention.

In a top view, in FIG. 1, the torque tongs device is shown in more detail. The shown torque tongs device comprises a motor 25 for rotation of a portion of the tongs means to screw together pipe joints. When the torque tongs device is provided with such a spinning motor, it consitutes a spinning and torque tongs device 3. The tongs means comprises a casing 10 which is split into two halves 10*a*, and 10*b*, respectively. Casing halves 10*a*, 10*b* can be locked together by the aid of a locking means 26 which is provided on the front edge of casing 10. Casing 10 can be split along its axis of division 50 so as to receive pipe sections in the tongs means. Each casing half 10*a*, 10*b* is swingable or pivoted about a common shaft 24. A fluid power cylinder 31 operates an opening and closing mechanism 25. The shown torque tongs means is also provided with sleeve guides 32 for slidable cooperation with guides 5 on carriage 4.

Figure 2:
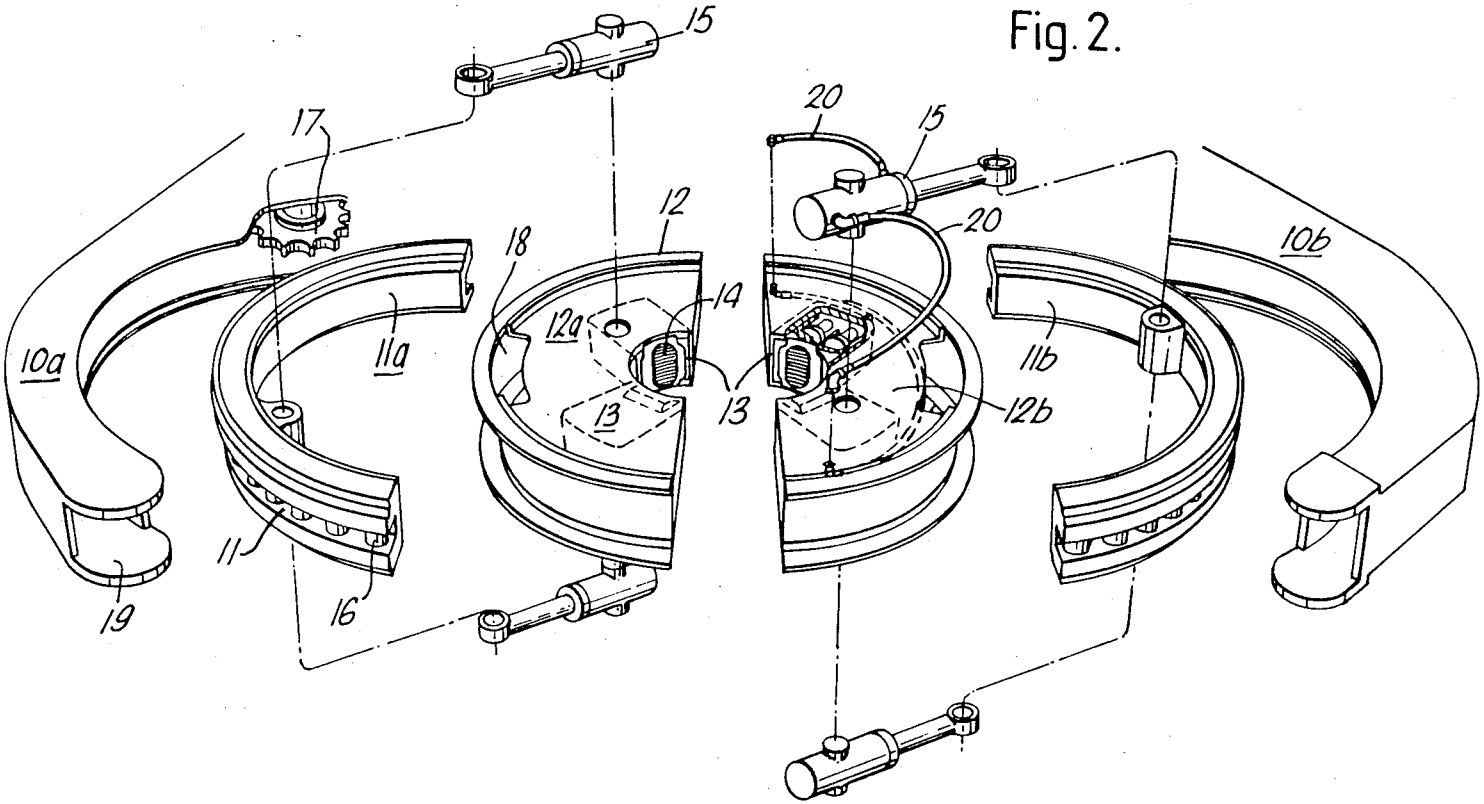
FIG. 2 is a perspective view of the front portion of the torque tongs device according to the invention.

The rotatable portion of the torque tongs device is shown in more detail in FIG. 2. The stationary portion of the tongs consists of casing halves 10*a*, 10*b*. The rotatable portions of the tongs device comprise an inner annulus 12, and an intermediate annulus 11. Intermediate annulus 11 is composed of two halves 11*a* and 11*b*. Correspondingly, inner annulus 12 is composed of two halves 12*a* and 12*b*. Inner annulus 12 is mounted in intermediate annulus 11 by the aid of a bearing. Intermediate annulus 11 is, in turn, mounted in casing 10. The bearings may be of any suitable kind, e.g. ball bearings, roller bearings, and slide bearings. The bearings may be removable, or they may form part of components. The bearing material may, e.g., be sprayed directly onto the portions that are movable relative to each other. It should be mentioned in this connection that movement between inner annulus 12 and intermediate annulus 11 will only occur along a small curved angular segment and will hardly create much wear. Essential rotation and relative movement will occur between intermediate annulus 11 and casing 10.

In the shown embodiment, intermediate annulus 11 is provided with bolts forming a tooth structure 16 for operative engagement with a gear 17 which is arranged on spinning motor 25. Spinning motor 25 may be of any desired kind, e.g. a hydraulic motor. Besides being mounted in intermediate annulus 11 the inner annulus 12 is connected with intermediate annulus 11 via pump cylinders 15. Pump cylinders 15 may be pneumatic, but are, preferably, hydraulic. Pump cylinders 15 are at one end connected with intermediate annulus 11 by the aid of, e.g. pivots (not shown). At the other end pump cylinders 15 are rotatably attached to inner annulus 12. The piston rod of pump cylinder 15 is preferably, but not necessarily, attached to intermediate annulus 11, and the casing of pump cylinder 15 is pivotally connected with inner annulus 12. Inner annulus 12 also comprises clamping cylinders 13 which are secured to inner annulus 12. Each inner annulus half 12*a* and 12*b* must have at least one such clamping cylinder 13. Even though the shown embodiment is provided with four clamping cylinders 13 any number of clamping cylinders from two upwards may be used. Clamping cylinders 13 control activable and displaceable clamping jaws intended for engagement with pipe joints. Pump cylinders 15 are connected with clamping cylinders 13 via pneumatic or hydraulic circuits 20, which constitute hoses in the shown embodiment. Instead of using hoses 20, channels may be drilled in the inner annulus 12. It should be observed that the pneumatic or hydraulic circuits are closed circuits; thus, there is no transmission of fluid between casing 10 and intermediate annulus 11 or inner annulus 12.

As shown, casing 10 as well as inner annulus 12 and intermediate annulus 11 are divided and may be split to receive a drill pipe. When the tongs device is to be split, intermediate annulus 11 and inner annulus 12 must, consequently, be in such a position relative to casing 10 that their respective division lines coincide with the division line or axis 50 of the casing. As shown in FIG. 1, a positioning valve 28 is provided to be activated mechanically, e.g. by projections on the intermediate and inner annulus. Whenever intermediate annulus and inner annulus are not within this area, the tongs cannot be split. In which casing half the respective annulus halves are present is of no consequence, so that the maximum rotation of rings 11,12 before they split is 180°. On the face of division between intermediate annulus halves 11*a*, 11*b* guides are preferably provided, e.g. pin and aperture (not shown). Corresponding guide pins and apertures may advantageously be provided on the faces of division of inner annulus halves 12*a* and 12*b*, respectively. As shown in the Figure, inner annulus 12 is also provided with recesses 18 for the pivot between intermediate annulus 11 and pump cylinder 15 to permit relative angular turning between intermediate annulus 11 and inner annulus 12.

A working cylinder 21 is mounted on casing 10 and intended to transmit the turning moment to intermediate annulus 11 to be transmitted to inner annulus 12. This working cylinder may be hydraulic, pneumatic, or mechanical and will act as a linear motor. Piston rod 33 of working cylinder 21 is rotatably connected with a displaceable casing 22, which is slidably mounted in casing 10. When working cylinder 21 is activated, sliding casing 22 describes a circular arch and will normally span a sector of 30°. Inside sliding casing 22, a pawl 23 is journalled in a pivot 34. When working cylinder 22 is in a retracted position, i.e. when piston rod 33 is totally retracted into working cylinder 21, pawl 23 is in a "resting position". When cylinder 21 is activated, a mechanism will cause pawl 23 to turn about pivot 34 until a nose member on the pawl contacts the inside of sliding casing 22. At the same time, a hook member 36 on pawl 23 engages the bolt tooth means and will cause rotation of inner annulus 11 when piston rod 33 is further extended, so that a moment of rotation is transmitted to inner annulus 11. As soon as the piston rod is retracted into working cylinder 21, e.g. a spring mechanism will turn pawl 23 back into its starting position. If necessary, working cylinder 21 can make a plurality of strokes to achieve the necessary moment. In the shown embodiment, pawl 23 acts on the same bolt tooth arrangement as spinning motor 25. These transfers, however, may be separate and could be achieved in a different manner, e.g. by the aid of a conventional gear rim.

As shown in FIG. 1, the torque tongs means can, advantageously, also be provided with a friction-generating means 30, e.g. corresponding to the conventional disk brake. In the shown embodiment, a caliper casing is secured to casing 10 of the torque tongs device, where activable frictional linings are intended to cooperate with a braking disk (not shown) that is secured to inner annulus 12. The function of friction means 30 will be disclosed in more detail below.

Figure 3:
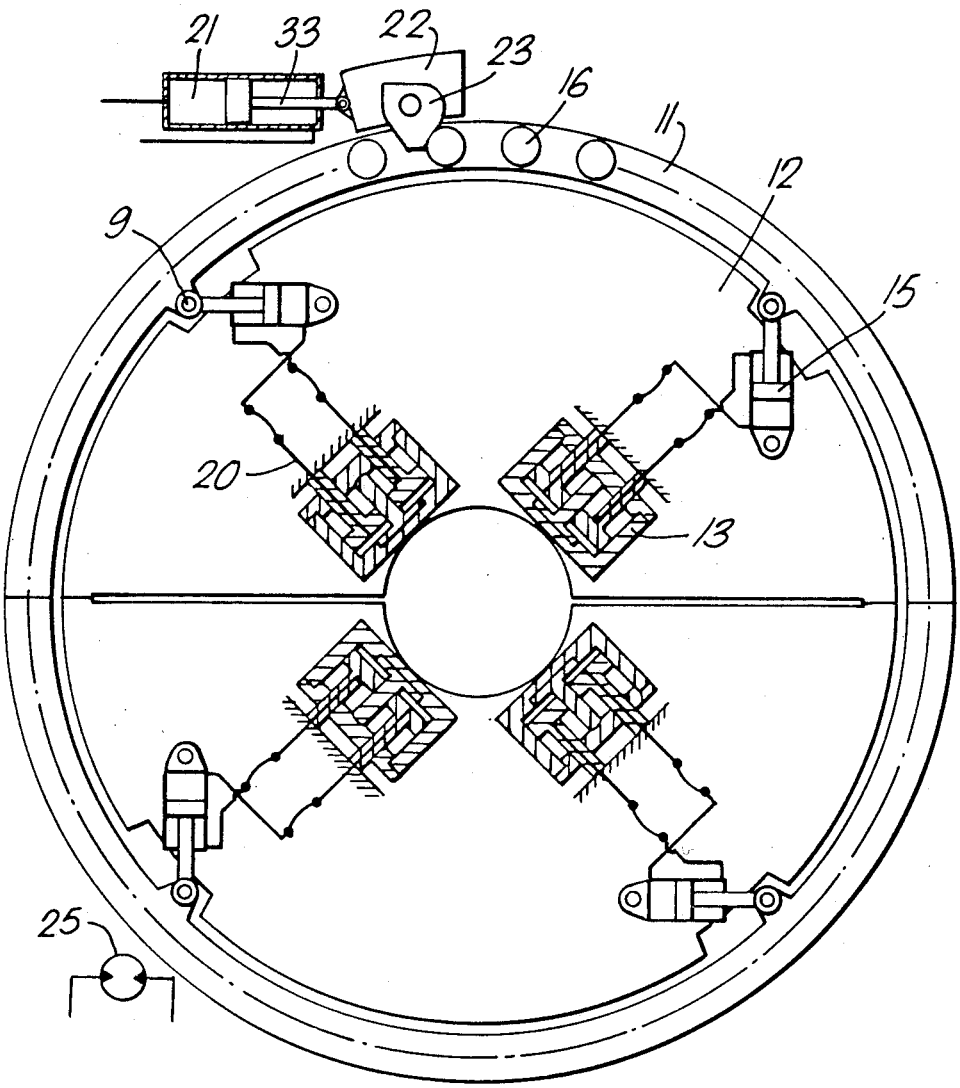
FIG. 3 is a diagrammatic view of the mode of operation of the tongs device.

FIG. 3 shows a diagrammatical view of the torque tongs device which will illustrate more clearly how the tongs device operates as well as its performance. Split inner annulus 12 is provided with four cylinders 13, each receiving a clamping jaw. Clamping jaws 14 are movable in cylinders 13 and provide a tongs device which is flexible as regards the dimensions of drill pipes. Normally, the tongs device may be used for pipe dimensions from 3.5" drill pipe to 9.5" drill collar. However, this range may be enlarged without special difficulties. Each cylinder 13 is connected with a pump cylinder 15, via a hydraulic circuit. Between inner annulus 12 and intermediate annulus 11, a slight relative angular movement is possible. When a pipe section 6 is gripped by the torque tongs device, brake means 30 is activated to hold inner annulus 12 temporarily. Then, intermediate annulus 11 is turned; the turning moment is, in turn, transmitted, via piston rods in pump cylinders 15, to activate the inner and closed hydraulic circuit. Thus, the pressure is transmitted to cylinders 13 and clamping jaws 14. The clamping jaws are displaced radially towards drill pipe 6 to center the pipe. In the Figure, four separate independent hydraulic circuits are shown, but in other embodiments one single pump cylinder 15 may activate two or all jaws in an inner annulus half 12*a*, 12*b*. Now, brake means 30 is released, and motor 25 spins intermediate annulus 11, inner annulus 12 with jaws 14, and the pipe section 6 as one single unit into a lower socket joint end 8 of a pipe section. When the pin end of the joint is spun into the socket of sleeve portion of the joint by the aid of spinning motor 25, which commonly contributes with a tightening moment in the order of 7 kNm, the final moment is made up by pressure in working cylinder 21 which is transmitted to inner annulus 11, via pawl 23. The pressure applied to working cylinder 21 has to be adjusted in accordance with the pipe diameter present in the tongs device.

The geometry of the connection between inner annulus 11 and intermediate annulus 12 should be noted. The connection is provided by pump cylinders 15. The line of action of cylinders 15 is especially notable. In case of large pipe, diameters, the lines of action of pump cylinders 15 will be tangential with relative large circles about the centre of pipe. In case of smaller pipe dimensions the line of action of cylinder 18 will be tangential with circles about the centre of pipe of smaller diameters, or, as shown in the Figure, pump cylinders 15 will move into a more radial position. As known, various tighteningmoments are required for various pipe dimensions, with the largest pipe dimensions requiring the largest tightening moment. It is, e.g., common to tighten conventional 3.5" drill pipes by 10 kNm, and large drill collars of 9.5" by 120–150 kNm. The shown concept permits the operator to adjust the clamping force of jaws 14 in a comparatively simple manner by the aid of the pressure applied to working cylinder 21. The geometry of the structure, indeed, ensures that the necessary force is achieved. In case of small pipe dimensions, the line of action of pump cylinders 15 is more radial, which would, in case of a constant turning moment of intermediate annulus 11, cause considerably higher radial forces in clamping jaws 14 than in case of large pipe dimensions. However, small pipe dimensions do in fact require a lower tightening moment and, consequently, working cylinder 21 should apply a lower turning moment to inner annulus 11. This lower turning moment, in turn, will cause a lower pressure in the inner circuits 20. Correspondingly, pressure in jaws 14 will decrease in case of increasing pipe diameters since pump cylinders 15 move to a tangential position in increasing circles about the pipe centre. This is compensated for by an increased pressure applied to working cylinder 21 so as to provide for a sufficient turning moment on intermediate annulus 11 and, consequently, an tightening torque to pipe joint 8. According to the above described process, the tightening moment may readily be adapted to various pipe dimensions, and that goes for clamping forces applied by jaws 14 to pipe joint 8 as well. Thus, the working surfaces of the pipe joints are spared in a much better manner than was previously possible.

Figure 4:
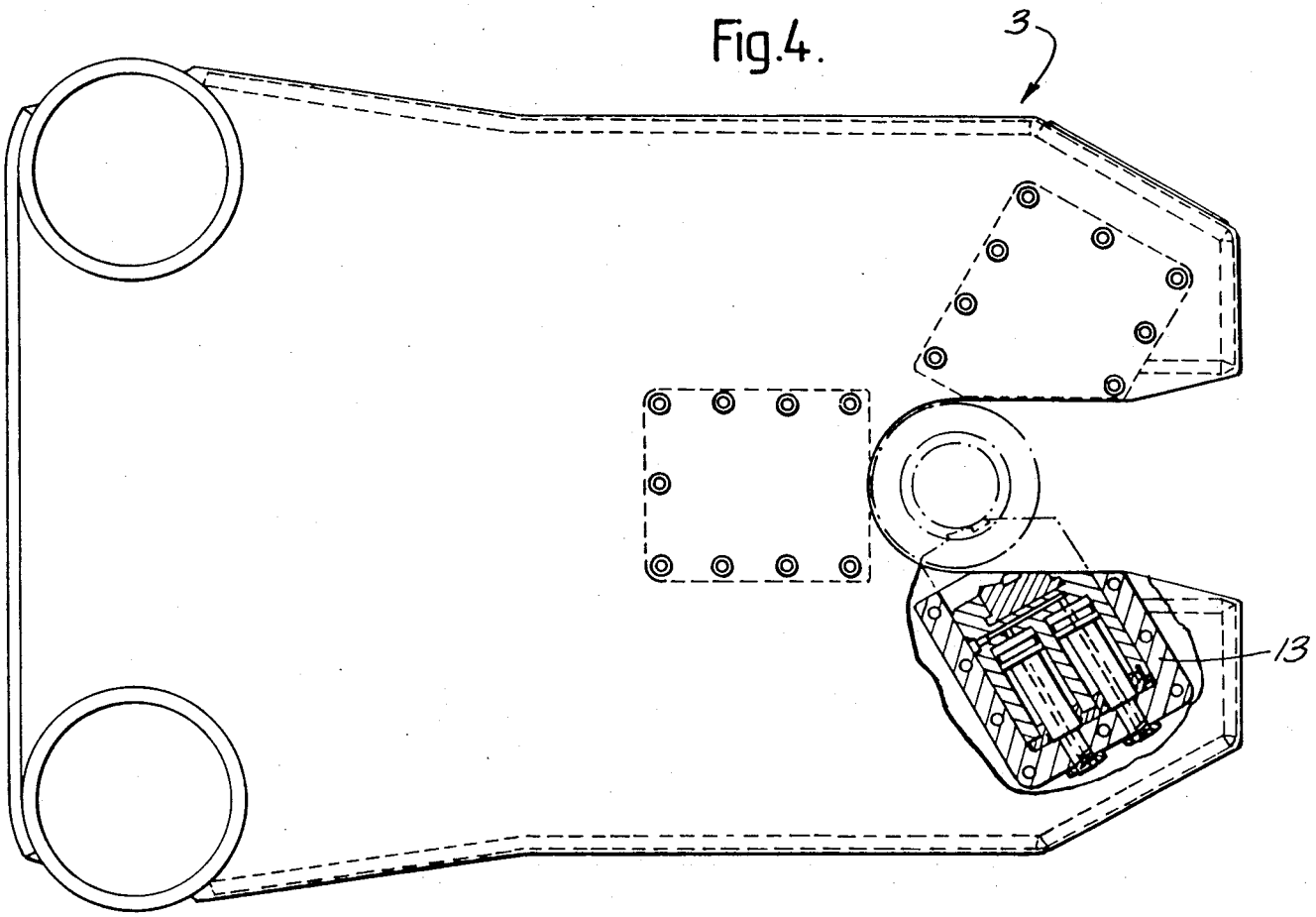
FIG. 4 is a diagrammatic view of a back-up tongs means, commonly mounted below the torque tongs device.

FIG. 4 is a diagrammatic view of a back-up tongs means which, indeed, can be of any suitable known kind, but is, advantageously of a flexible dimension kind. The shown tongs means is of a kind having a constant opening and is, thus, not a split kind. Three cylinders with associated clamping jaws are shown, but any suitable number of cylinders may be used. The back-up tongs means is vertically movable in relation to the torque tongs device, preferably along the same guides 5 as used by torque tongs device 2.

Each cylinder 13 holding and guiding the clamping jaws 14 is of a kind known per se and therefore is not disclosed in detail. It should, however, be mentioned that they are of a certain length to be flexible in relation to the intended range of dimensions, at the same time as they ensure good lateral support and guidance within their entire operative range of movement.

Having described my invention, I claim:

1. A torque wrench for tightening and breaking-out a threaded joint between an upper end of a lower, vertically oriented pipe section, and a lower end of an upper, vertically oriented pipe section, while the lower pipe section is being supported so as to permit the upper pipe section to be rotated with respect thereto about coinciding longitudinal axes of the upper and lower pipe sections, said torque wrench comprising:

a radially inner annulus which is split into two angularly complementary halves;

a radially intermediate annulus which is split into two angularly complementary halves;

a radially outer casing which is split into two angularly complementary halves;

said inner annulus being mounted to said intermediate annulus for limited angular movement of said inner annulus relative to said intermediate annulus, about coinciding, vertically oriented longitudinal axes thereof;

said intermediate annulus being mounted to said casing for angular rotation of said intermediate annulus relative to said casing, about coinciding, vertically oriented longitudinal axes thereof;

means hinging and removably connecting said halves of said casing to one another so that, when corresponding halves of said inner annulus, said intermediate annulus and said casing are arranged on opposite sides of a rotational longitudinal plane of division containing said longitudinal axes of said annuli and said casing, said casing halves may be disconnected, swing apart to an open condition, swing together to a closed condition and reconnected;

means defining a vertically oriented central opening through said inner annulus, adopted to receive and circumferentially surround a lower end of an upper, vertically oriented pipe section;

each half of said inner annulus being provided with at least one clamping jaw mounted for movement towards and away from the longitudinal axis of said inner annulus respectively for centralizing and frictionally engaging, and releasing said lower end of said upper, vertically oriented pipe when said lower end of said upper, vertically oriented pipe section is received in said central opening of said inner annulus;

means associated with said casing, for selectively rotating said intermediate annulus with respect to said casing, about the longitudinal axis of the intermediate annulus, in a desired angular direction;

means operatively connecting said intermediate annulus with said inner annulus for effecting a limited extent of angular rotation of said inner annulus relative to said intermediate annulus, in a desired angular direction, when said means associated with said casing is used for selectively rotating said intermediate annulus in a desired angular direction; and said operatively connecting means also being operatively connected with said clamping jaws for moving said clamping jaws towards the longitudinal axis of said inner annulus as said inner annulus is rotated to a limited extent in one angular direction about said longitudinal axis of said inner annulus, and for permitting said clamping jaws to move away from the longitudinal axis of said inner annulus as said inner annulus is rotated to a limited extent in an opposite angular direction about said longitudinal axis of said inner annulus.

2. A torque wrench of claim 1, further comprising:

selectively activatable friction-generating brake means provided between said casing and said inner annulus, for preventing, when activated, angular rotation of said inner annulus relative to said casing about said longitudinal axis of said casing.

3. The torque wrench of claim 1, wherein:

said operatively connecting means comprises at least one tangentially arranged pressurized fluid-powered extensible-retractable piston and cylinder arrangement having opposite ends pivotally connected respectively to said inner annulus and said intermediate annulus.

4. The torque wrench of claim 3, wherein:

each said fluid-powered piston and cylinder arrangement is hydraulic fluid-powered;

said clamping jaws are hydraulic fluid-powered for movement towards said longitudinal axis of said inner annulus; and said operatively connecting means is operatively connected with said clamping jaws by hydraulic fluid line means.

5. The torque wrench of claim 4, further including:

a respective radially oriented guiding cylinder receiving each clamping jaw and being mounted on said inner annulus for guiding movement of said clamping jaws radially towards said longitudinal axis of said inner annulus, for facilitating frictional engagement by said clamping jaws of pipe sections of a range of different outer diameters.

6. The torque wrench of claim 4, wherein:

each said hydraulic fluid powered piston cylinder arrangement is double-acting, whereby said clamping jaws, in use, are also forcibly released.

7. The torque wrench of claim 1, wherein:

said intermediate annulus is mounted to said casing for 360° angular rotation of said intermediate annulus relative to said casing, about said coinciding, vertically oriented longitudinal axes thereof.

8. The torque wrench of claim 1, wherein said means associated with said casing, comprises:

a motor mounted between said casing and said intermediate annulus for power-rotating said intermediate annulus relative to said casing about said coinciding, vertically oriented longitudinal axes of said casing and said intermediate annulus.

9. A roughneck assembly for tightening and breaking-out a threaded joint between an upper end of a lower, vertically oriented pipe section, and a lower end of an upper, vertically oriented pipe section, comprising:

a vertically oriented guide means;

a torque wrench mounted to said guide means, and a back-up wrench mounted to said guide means, with said back-up wrench disposed below said torque wrench, for supporting a lower pipe section against rotation about the longitudinal axis of such lower pipe section, as said torque wrench is used on an upper pipe section for rotating the upper pipe section with respect to the lower pipe section about coinciding longitudinal axes of said upper and lower pipe sections;

said torque wrench comprising:

a radially inner annulus which is split into two angularly complementary halves;

a radially intermediate annulus which is split into two angularly complementary halves;

a radially outer casing which is split into two angularly complementary halves;

said inner annulus being mounted to said intermediate annulus for limited angular movement of said inner annulus relative to said intermediate annulus, about coinciding, vertically oriented longitudinal axes thereof;

said intermediate annulus being mounted to said casing for angular rotation of said intermediate annulus relative to said casing, about coinciding, vertically oriented longitudinal axes thereof;

means hinging and removably connecting said halves of said casing to one another so that, when corresponding halves of said inner annulus, said intermediate annulus and said casing are arranged on opposite sides of a rotational longitudinal plane of division containing said longitudinal axes of said annuli and said casing, said casing halves may be disconnected, swing apart to an open condition, swing together to a closed condition and reconnected;

means defining a vertically oriented central opening through said inner annulus, adopted to receive and circumferentially surround a lower end of an upper, vertically oriented pipe section;

each half of said inner annulus being provided with at least one clamping jaw mounted for movement towards and away from the longitudinal axis of said inner annulus respectively for centralizing and frictionally engaging, and releasing said lower end of said upper, vertically oriented pipe when said lower end of said upper, vertically oriented pipe section is received in said central opening of said inner annulus;

means associated with said casing, for selectively rotating said intermediate annulus with respect to said casing, about the longitudinal axis of the intermediate annulus, in a desired angular direction;

means operatively connecting said intermediate annulus with said inner annulus for effecting a limited extent of angular rotation of said inner annulus relative to said intermediate annulus, in a desired angular direction, when said means associated with said casing is used for selectively rotating said intermediate annulus in a desired angular direction; and said operatively connecting means also being operatively connected with said clamping jaws for moving said clamping jaws towards the longitudinal axis of said inner annulus as said inner annulus is rotated to a limited extent in one angular direction about said longitudinal axis of said inner annulus, and for permitting said clamping jaws to move away from the longitudinal axis of said inner annulus as said inner annulus is rotated to a limited extent in an opposite angular direction about said longitudinal axis of said inner annulus;

at least one of said torque wrench and said back-up wrench being vertically adjustably movable on said guide means.

10. The roughneck of claim 9, further including:

a horizontally mobile carriage;

said guide means being supported on said carriage for horizontal movement therewith.

* * * * *